US005395182A

United States Patent [19]

Rossburger

[11] Patent Number: 5,395,182

[45] Date of Patent: Mar. 7, 1995

[54] ROAD COMPACTING APPARATUS

[76] Inventor: Peter Rossburger, P.O. Box 1110, Blairmore, Alberta, Canada, T0K 0E0

[21] Appl. No.: 59,300

[22] Filed: May 11, 1993

[51] Int. Cl.[6] ..... E01C 19/27

[52] U.S. Cl. ..... 404/122; 404/128

[58] Field of Search ..... 404/122, 128, 124, 127, 404/117, 102, 122, 125, 126

[56] References Cited

U.S. PATENT DOCUMENTS

| | | | |
|---|---|---|---|
| 2,078,290 | 4/1937 | Sloan | 404/117 |
| 2,407,965 | 5/1943 | Smith | 404/122 |
| 2,624,251 | 1/1953 | Porter | 404/122 |
| 3,119,313 | 1/1964 | Neidhardt et al. | 404/125 |
| 3,232,189 | 5/1962 | Young | 404/122 |
| 3,291,013 | 3/1964 | Stolp | 404/128 |
| 3,401,611 | 9/1968 | Schneider | 404/128 |

*Primary Examiner*—Ramon S. Britts
*Assistant Examiner*—Pamela A. O'Connor
*Attorney, Agent, or Firm*—George H. Dunsmuir

[57] ABSTRACT

In general, apparatuses or machines for compacting the shoulders of roads include a plurality of wheels in side by side relationship, which are merely rolled over the gravel shoulder of a road. Such machines rely on the weight of the wheels to effect compacting. An apparatus for effecting more efficient compacting includes a frame for connection to a towing vehicle, a fixed arm extending rearwardly from the frame, a pivot arm pivotally connected to the fixed arm for limited rotation around an axis perpendicular to the direction of travel of the apparatus, crossbars pivotally connected to the pivot arm for limited rotation around an axis parallel to the direction of travel of the apparatus, a plurality of vertical arms connected to the crossbars and extending downwardly therefrom for pivotally supporting axles for rotation around axles perpendicular to the direction of travel, and a wheel mounted on the outer end of each axle, whereby the wheels are caused to wobble as they are drawn over a gravel shoulder to effect efficient compacting of the gravel.

5 Claims, 6 Drawing Sheets

ROAD COMPACTING APPARATUS

BACKGROUND OF THE INVENTION

This invention relates to a roadworking apparatus, and in particular to an apparatus for compacting gravel roads and the shoulders thereof.

It is know to use a plurality of pneumatic tires in side-by-side relationship for compacting road shoulders. Examples of machines for effecting compacting in this manner are disclosed by, for example U.S. Pat. No. 3,146,686, which issued to W. E. Grace et al on Sept. 1, 1964; U.S. Pat. No. 3,291,013, which issued to L. J. Stolp on Dec. 13, 1966 and U.S. Pat. No. 3,993,413, which issued to R. N. Cox et al on Nov. 26, 1976.

While the machines disclosed by these patents are more or less effective, a problem common to machines of the patented type is that of wheel motion, i.e. insufficient vibratory motion is imparted to the wheels to effect efficient compacting. It has been found that wobbling of the wheels improves the compacting action of the machine.

SUMMARY OF THE INVENTION

The object of the present invention is to solve the above identified problem by providing a relatively simple compacting apparatus, the wheels of which are free to oscillate or vibrate both longitudinally and transversely of the direction of travel of the apparatus.

Accordingly, the present invention relates to a road compacting apparatus comprising main frame means for connection to a towing vehicle; fixed arm means extending rearwardly from said frame means for movement therewith; pivot arm means pivotally connected to said axis fixed arm means for limited rotation around an perpendicular to the direction of travel of the apparatus during normal use; crossbar means pivotally connected to said pivot arm means for limited rotation around an axis parallel to the direction of travel of the apparatus; vertical wheel arm means extending downwardly from said crossbar means; axle means pivotally connected to the bottom end of said wheel arm means for limited rotation around an axis perpendicular to the direction of travel of the apparatus; and wheel means mounted on said axle means, whereby because of rotation of said pivot arm means, said crossbar means and said axle means, said wheel means are caused to wobble longitudinally and transversely of the apparatus for compacting a road.

BRIEF DESCRIPTION OF THE DRAWINGS

The invention will be described in greater detail with reference to the accompanying drawings, which illustrate a preferred embodiment of the invention, and wherein.

Figure 5:
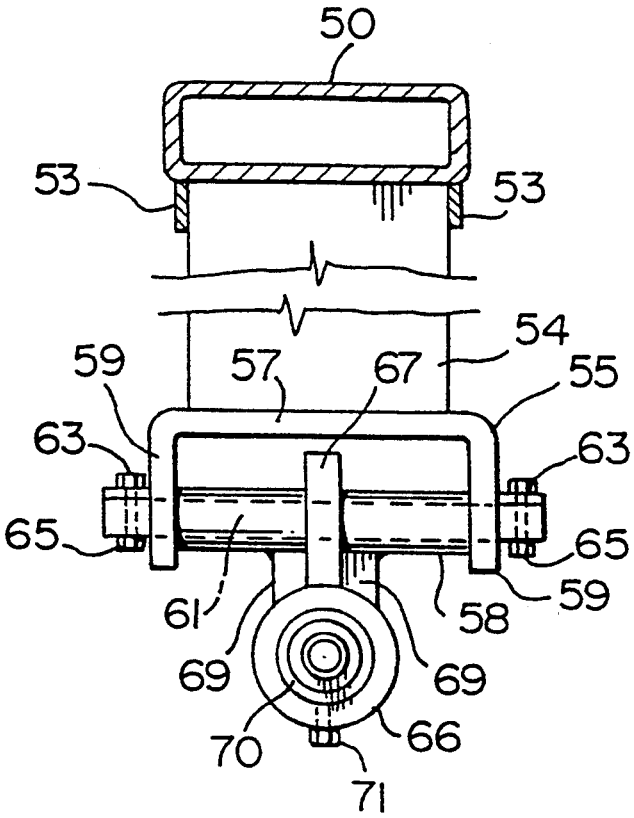
FIG. 5 is a cross section taken generally along line V—V of FIG. 2 with parts omitted.
Figure 6:
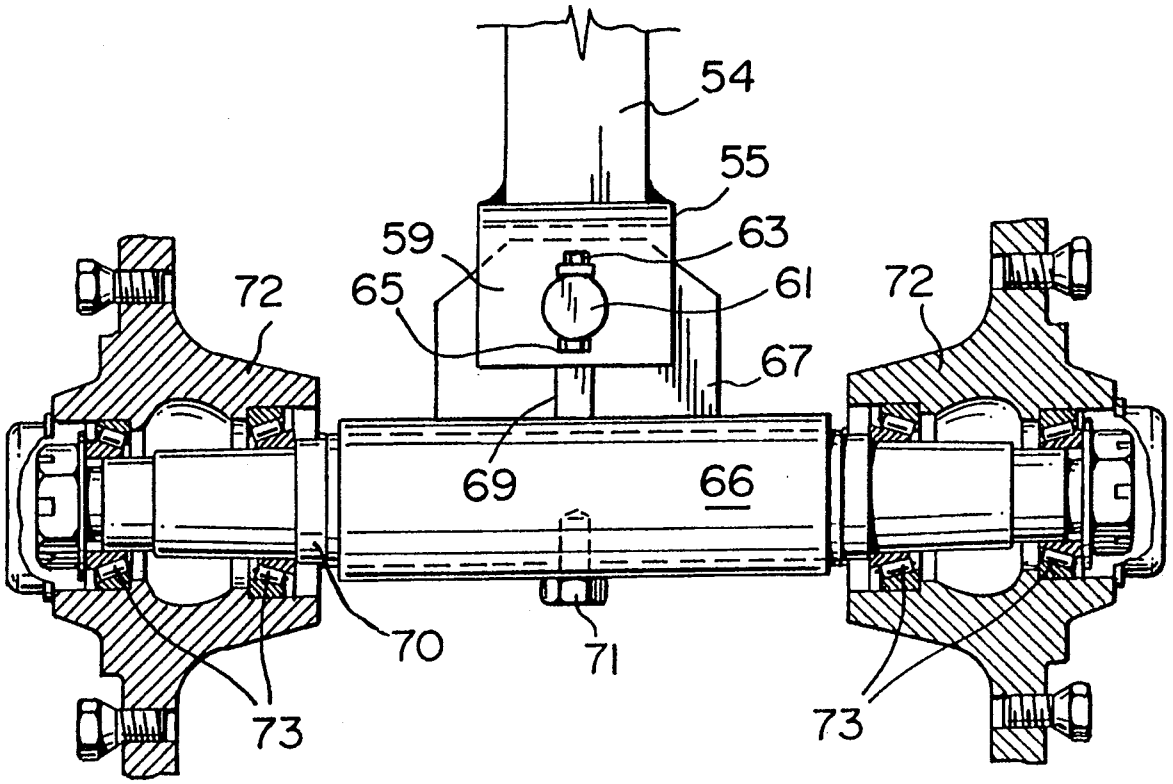
FIG. 6 is a cross section taken generally along line VI—VI of FIG. 3 with parts omitted.

It will be noted that FIG. 6 is also a side view of FIG. 5 with parts added.

DESCRIPTION OF THE PREFERRED EMBODIMENTS

Figure 3:
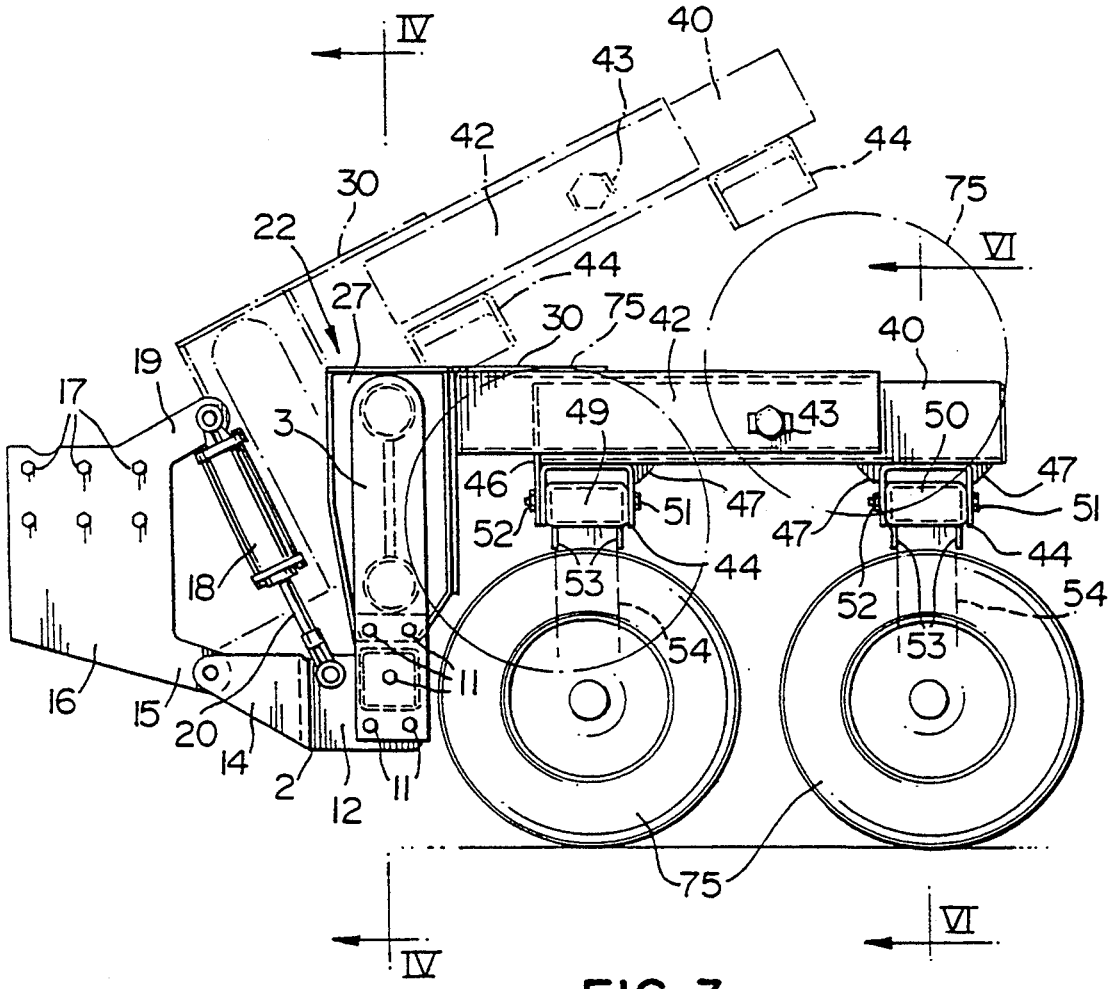
FIG. 3 is a side view of the apparatus of FIGS. 1 and 2.
Figure 4:
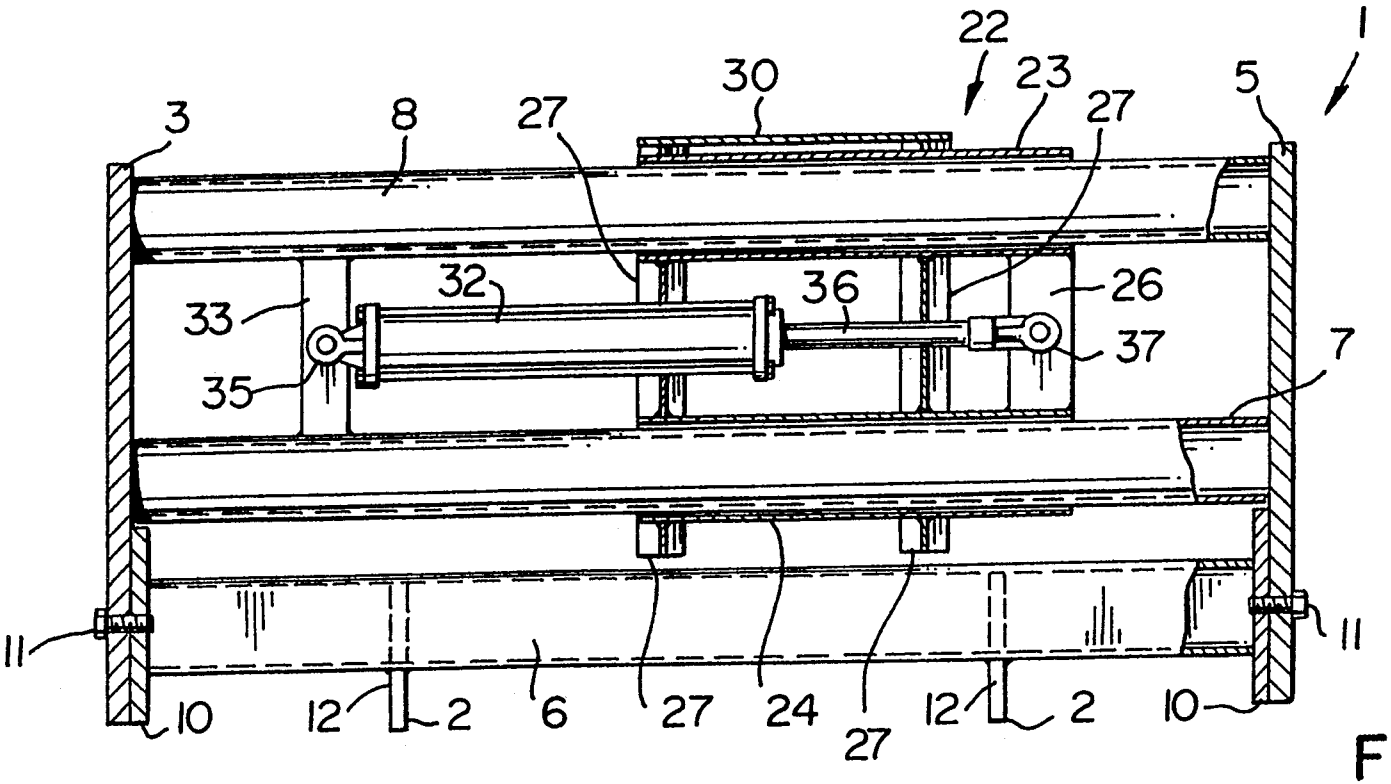
FIG. 4 is a cross section taken generally along line IV—IV of FIG. 3.

Referring to FIGS. 1 to 4, the apparatus of the present invention, which is in the form of a trailer for towing being a grader (not shown) includes a main frame generally indicated at 1 (FIG. 4) with a pair of towbars 2 extending forwardly therefrom. As best shown in FIG. 4, the frame 1 is defined by a pair of end plates 3 and 5 interconnected by tubular metal crossbars 6, 7 and 8. The crossbar 6 is square, and the crossbars 7 and 8 are circular in cross section. Reinforcing plates 10 are provided between the ends of the crossbar 6 and the end plates 3 and 5. The plates 10 are connected to the end plates 3 and 5 by bolts 11 (FIGS. 3 and 4).

Each towbar 2 includes a bottom plate 12 welded to the crossbar 6 on each side of the center thereof, and a pair of generally triangular plates 14 connected to the outer end of the plate 12 defining a clevis for pivotally supporting the bottom arm 15 of a support plate 16. The plates 16 are fixedly connected to the towing vehicle, usually a grader (not shown) by bolts 17. A pair of hydraulic cylinders 18 (one shown—FIG. 3) are pivotally mounted on a top arm 19 of the plate 16. The free ends of the piston rods 20 extending out of the cylinders 18 are pivotally connected to the bottom plates 12. Thus, the cylinder 18 can be actuated to raise or lower the apparatus, i.e. to move the apparatus between the transport position shown in phantom outline and the use position shown in solid lines in FIG. 3.

Referring to FIG. 4 to the two cylindrical crossbars 7 and 8 act as tracks for a carriage generally indicated at 22. The carriage 22 includes a pair of spaced apart tubes 23 and 24 slidably mounted on the crossbars 7 and 8. The tubes 23 and 24 are interconnected at one end by a vertical bar 26 and by carriage end plates 27 in the form of I-beams. A back plate 29 (FIGS. 1 and 2) is welded to the plates 27 and a top plate 30 extends from the front end of the plates 27 rearwardly beyond the back plate 29. The carriage 22 is moved along the tracks defined by the crossbars 7 and 8 by a hydraulic cylinder 32 pivotally connected to a bar 33 extending vertically between the crossbars 7 and 8 by a clevis 35. A piston rod 36 extending out of the cylinder 32 is connected to the vertical bar 26 at the end of the carriage 22 furthest from the bar 33 by a clevis 37. By extending the piston rod 36, the carriage 22 can be caused to slide transversely of the apparatus.

Figure 1:
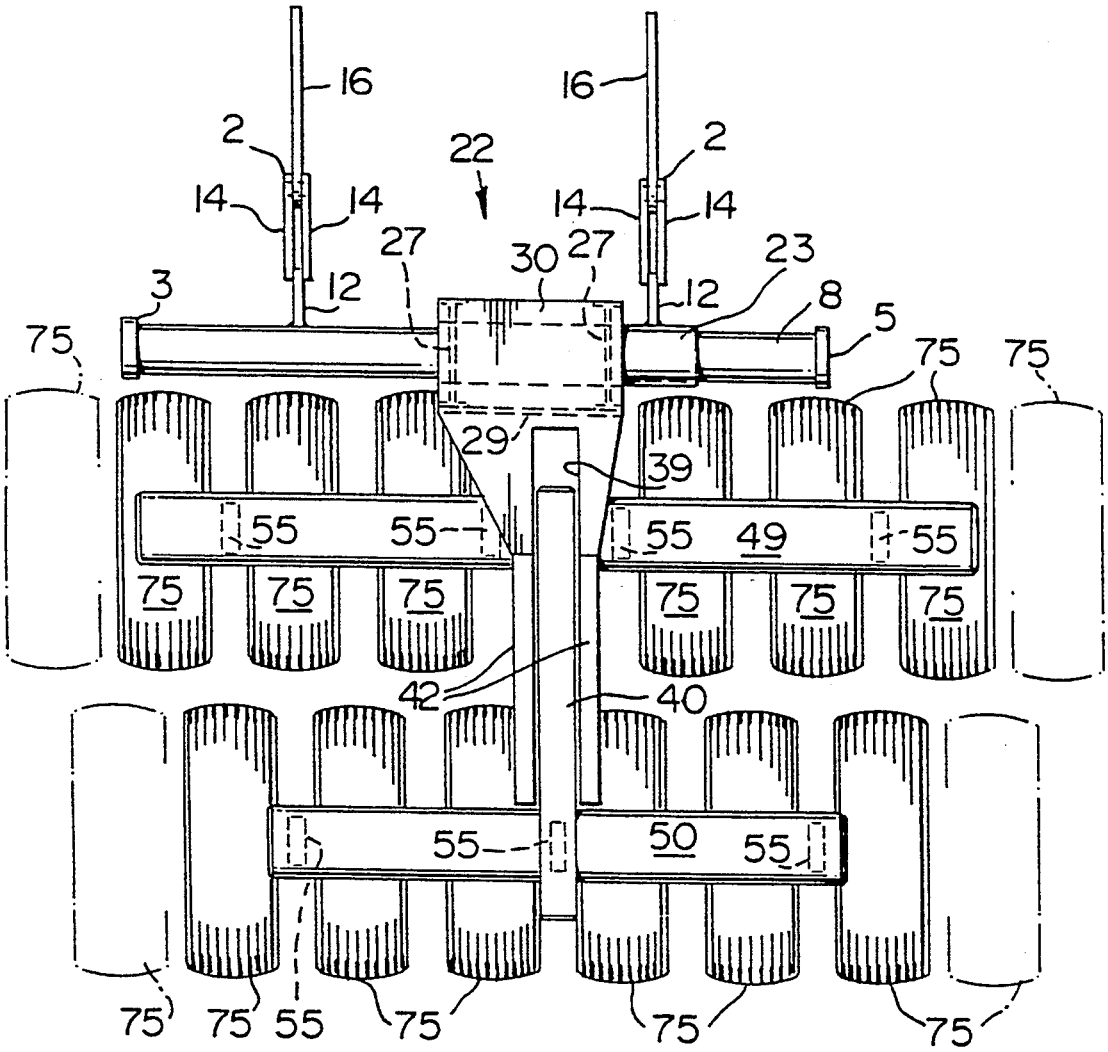
FIG. 1 is a plan view of a road compacting apparatus in accordance with the present invention.
Figure 2:
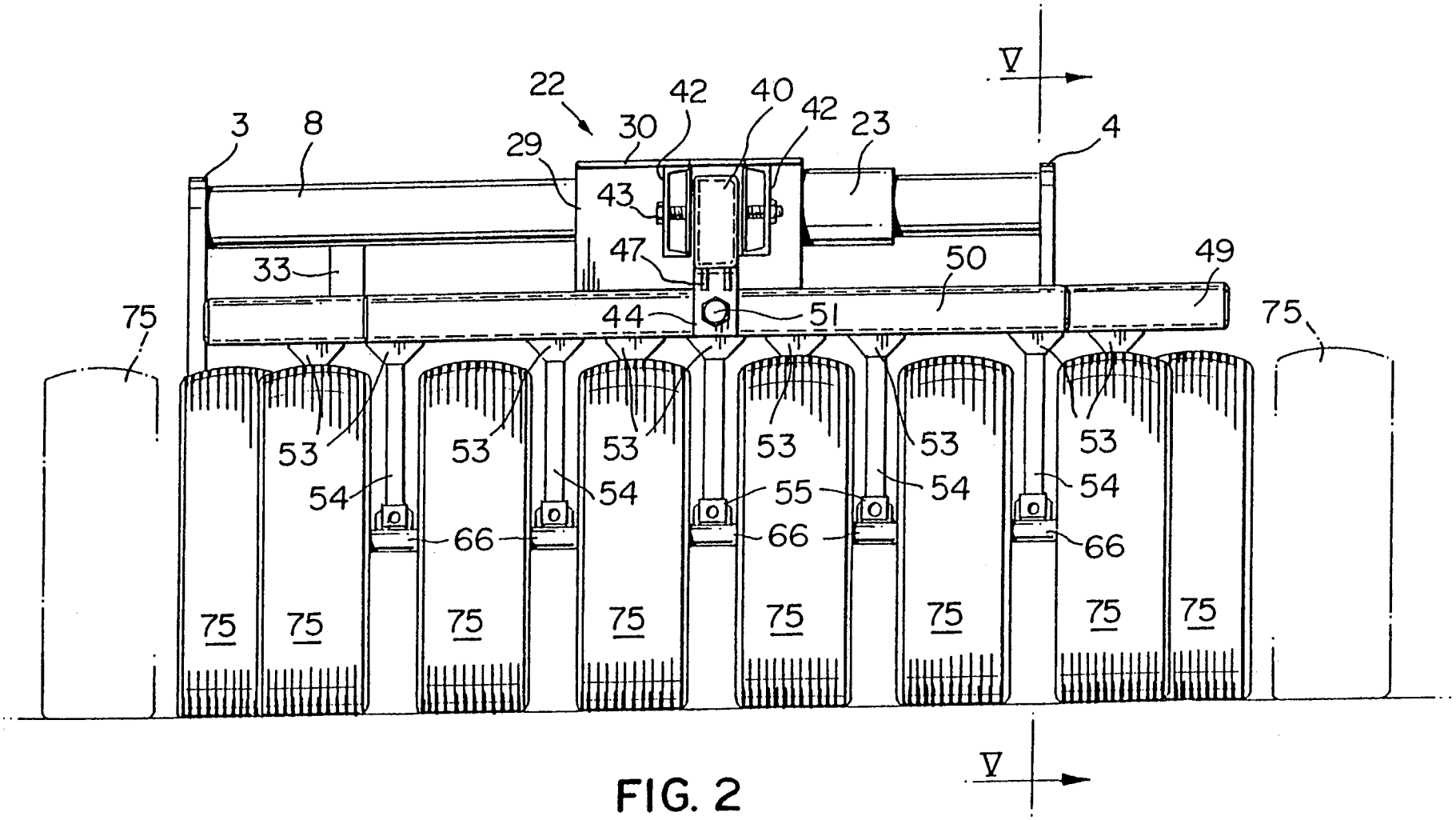
FIG. 2 is a rear end view of the apparatus of FIG. 1.

As best shown in FIG. 1 the trailing end of the top plate 30 is tapered and bifurcated, including a slot 39 for receiving the front end of a longitudinally extending pivot arm beam 40. A pair of parallel, spaced apart beams 42 defining a bifurcated, fixed arm are connected to a back plate 29 and to the bottom of the plate 30. The beams 42 extend rearwardly to define a fixed, rearwardly extending arm containing the remainder of the slot 39. The beam 40 is pivotally mounted on a bolt 43 extending between the beams 42 for rotation in the slot 39 around an axis transverse to the longitudinal axis of the apparatus.

An inverted U-shaped bracket 44 is connected to the bottom of the beam 40 at each of the front and rear ends thereof. Reinforcement in the form of a front plate 46 and gussets 47 are provided between the beam 40 and the brackets 44. Transversely extending crossbars or beams 49 and 50 are pivotally mounted in the brackets 44 using bolts 51 and nuts 52, so that the beams can pivot around horizontal axis parallel to the longitudinal axis of the apparatus. A plurality of spaced apart pairs of plates 53 extend downwardly from the beams 49 and 50 for fixedly supporting rectangular cross section wheel arms or legs 54.

A generally C-shaped bracket 55 is welded to the bottom end of each leg 54. The bracket 55, which opens downwardly, has open sides 57 which open towards the sides of the apparatus. A sleeve 58 extends between the arms 59 of the bracket 55, and a pin 61 extends through the sleeve 58 can be rotated on the pin 61. A second sleeve or cylindrical axle housing 66 is connected to the sleeve 61 for rotation therewith by a hexagonal plate 67 and generally rectangular gussets 69. Rotation of the plate 67 is limited by the fact that the plate strikes the top of the bracket 55 at each end of its arc of travel. An axle 70 is mounted in the housing 66. The axle 70 is retained in the housing 66 and prevented from rotating by a bolt 71 extending through the housing into the axle. Hubs 72 are rotatably mounted on the ends of the axle 70 by means of roller bearings 73. Each hub 72 carries a wheel 75.

In operation, by actuating the cylinder 18, the frame 1 can be rotated around the axis of the outer end of the arm of the towbars 2 to lower the wheels 75 from the elevated, transport position shown in phantom outline to the ground engaging position shown in solid outline in FIG. 3. Simultaneously, the cylinder 32 can be actuated to move the carriage 22 transversely of the frame 1 so that the wheels 75 are positioned over the shoulder to be worked.

Once the wheels 75 have been lowered into contact with a gravel road, with the grader moving forwardly, the wheel 75 wobbles along the road. The cylinder 18 is actuated to push the wheels downwardly under a high pressure, in this case 1250 psi. This force plus the weight of the apparatus (approximately 2500 pounds) and the wobbling action effect more or less even compacting of a freshly graded road surface.

What I claim is:

1. A road compacting apparatus comprising main frame means for connection to a towing vehicle in spaced apart relationship thereto; bifurcated, fixed arm means extending horizontally rearwardly from said frame means for movement therewith; pivot arm means pivotally mounted in said fixed arm means for limited rotation around an axis between the ends of the pivot arm means and perpendicular to the direction of travel of the apparatus during normal use; crossbar means pivotally connected to each end of said pivot arm means for limited rotation around parallel to the direction of travel of the apparatus; a plurality of separate spaced apart, vertical wheel arm means extending downwardly from each said crossbar means; axle means pivotally connected to the bottom end of each said wheel arm means for limited rotation around an axis perpendicular to the direction of travel of the apparatus; and wheel means mounted on said axle means, whereby because of pivoting of said pivot arm means, said crossbar means and said axle means, said wheel means are caused to wobble longitudinally and transversely of the apparatus for compacting a road.

2. An apparatus according to claim 1, including track means on said main frame means extending transversely of the direction of travel of the apparatus during use; carriage means slidable on said track means for movement in a direction perpendicular to said direction of travel, said carriage means carrying said fixed arm means, whereby said fixed arm means and said wheel means can be moved transversely of the frame means for compacting the shoulder of a road.

3. An apparatus according to claim 2, including fluid actuated cylinder means mounted on said main frame means; and piston rod means extending out of said cylinder means connected to said carriage means for moving the carriage means transversely of the apparatus.

4. An apparatus according to claim 1, including bracket means on the bottom end of each said wheel arm means pivotally supporting said axle means for limited rotation in the bracket means.

5. An apparatus according to claim 4, including first sleeve means rotatably mounted in said bracket means for rotation around an axis perpendicular to the direction of travel of the apparatus; plate means connected to said first sleeve means and extending downwardly therefrom; and second sleeve means suspended from and perpendicular to said first sleeve means for receiving said axle means.

* * * * *